US005235946A

United States Patent [19]

Fodale et al.

[11] Patent Number: 5,235,946

[45] Date of Patent: Aug. 17, 1993

[54] METHOD OF VARIABLE TARGET IDLE SPEED CONTROL FOR AN ENGINE

[75] Inventors: Francis M. Fodale, Beverly Hills; Glen E. Tallarek, Grosse Pointe Woods, both of Mich.

[73] Assignee: Chrysler Corporation, Highland Park, Mich.

[21] Appl. No.: 876,643

[22] Filed: Apr. 30, 1992

[51] Int. Cl.[5] ..... F02M 3/00; F02B 23/00

[52] U.S. Cl. ..... 123/339; 123/585

[58] Field of Search ..... 123/339, 198 R, 417, 123/418, 585

[56] References Cited

U.S. PATENT DOCUMENTS

| | | | |
|---|---|---|---|
| 4,381,042 | 4/1983 | Perry | 180/272 |
| 5,048,483 | 9/1991 | Nakazawa | 123/339 |
| 5,057,764 | 10/1991 | Fujimoto et al. | 322/14 |
| 5,080,059 | 1/1992 | Yoshida et al. | 123/198 R |
| 5,081,973 | 1/1992 | Minamitani | 123/339 |
| 5,083,541 | 1/1992 | Chan | 123/339 |
| 5,111,788 | 5/1992 | Washino | 123/339 |
| 5,113,827 | 5/1992 | Vincent | 123/411 |
| 5,133,319 | 7/1992 | Ikada et al. | 123/339 |
| 5,136,997 | 8/1992 | Takahashi et al. | 123/339 |
| 5,146,888 | 9/1992 | Sawamoto | 123/339 |

*Primary Examiner*—Raymond A. Nelli

*Attorney, Agent, or Firm*—Mark P. Calcaterra

[57] ABSTRACT

A method of controlling the target idle speed of an internal combustion engine having sensors for monitoring engine coolant temperature, engine speed, and battery voltage.

20 Claims, 4 Drawing Sheets

METHOD OF VARIABLE TARGET IDLE SPEED CONTROL FOR AN ENGINE

BACKGROUND OF INVENTION

Field of the Invention

The present invention relates generally to target idle speed control for an internal combustion engine primarily intended for motor vehicle use, and more particularly, to a method of variable target idle speed control for an internal combustion engine.

Description of the Related Art

A conventional electronic engine idle speed control system works to control the engine speed during an idle condition (closed throttle) to converge on a single fixed target idle speed by actual engine speed feedback control of an air bypass valve. The amount of air that flows through the air bypass valve varies with how "wide" the air bypass valve is opened. The amount of air that the engine needs to maintain the target idle speed varies with such things as engine temperature, ambient air temperature, and engine loading. The variation in engine loading comes from such things as transmission loads, air conditioner compressor loads, alternator loads, and power steering pump loads (accessory loads). Since a particular ratio of fuel to air is desired, the engine idle fuel consumption (fuel mass flow rate) is directly proportional to the air mass flow rate of the bypass air which is directly related to idle speed and engine loading. It follows, then, that engine idle fuel consumption can be reduced by reducing either the idle speed or the engine loading which, in turn, would increase the overall engine fuel economy.

As a result, there is a need in the art to control the engine to lower target idle speeds. Also, there is a need in the art to vary the target idle speed of the engine. There is a further need in the art to reduce idle fuel consumption and increase overall fuel economy.

SUMMARY OF THE INVENTION

It is, therefore, one object of the present invention to provide a method of target idle speed control for an internal combustion engine.

It is another object of the present invention to provide a method of variable target idle speed control for an internal combustion engine.

It is yet another object of the present invention to control an internal combustion engine to lower target idle speeds.

It is still another object of the present invention to vary the target idle speed for an internal combustion engine.

It is a further object of the present invention to reduce idle fuel consumption and increase overall fuel economy.

To achieve the foregoing objects, the present invention is a method of controlling a target idle speed of an internal combustion engine having sensors for determining and monitoring engine coolant temperature, engine rotational speed, battery voltage, battery temperature, throttle position, environmental ambient air temperature, transmission status, and air conditioning system status. The method includes the steps of determining if predetermined conditions have been met by evaluating signals from the sensors. The method also includes the steps of disabling a "variable" control of the target idle speed and enabling a "conventional" control of the target idle speed if the predetermined conditions have not been met. The method also includes the steps of enabling the "variable" control of target idle speed and disabling the "conventional" control of the target idle speed if the predetermined conditions have been met. The method further includes the steps of varying the target idle speed between predetermined minimum and maximum values according to the actual battery voltage level relative to the target battery voltage level if the "variable" control method is enabled.

One advantage of the present invention is that a method of variable target idle speed control is provided for an internal combustion engine. The variable target idle speed feature raises or lowers the target idle speed when enabling conditions are satisfied. The variable target idle speed feature controls the engine's target idle speed between a maximum value and a minimum value in order to maintain a minimum battery voltage level. The lower target idle speeds result in a decrease in idle fuel consumption which will lead to an increase in overall fuel economy.

Other objects, features and advantages of the present invention will be readily appreciated as the same becomes better understood after reading the following description taken in conjunction with the accompanying drawings.

DESCRIPTION OF THE PREFERRED EMBODIMENT(S)

Figure 1:
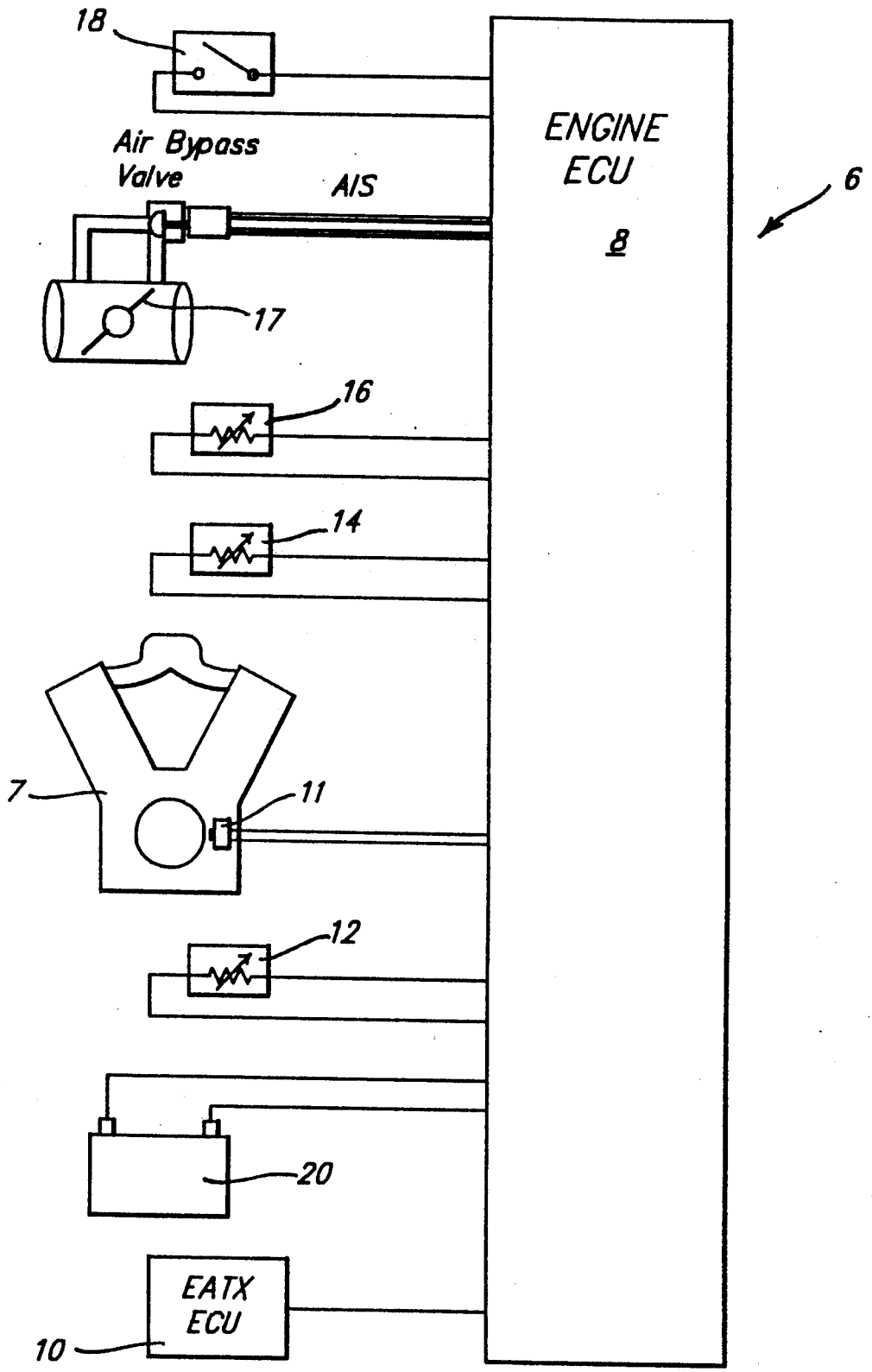
FIG. 1 is a schematic diagram of an engine control system utilized in a variable target idle speed methodology according to the present invention.

Referring to FIG. 1, an idle speed control system 6 is shown for an internal combustion engine 7. The idle speed control system 6 includes an Electronic Control Unit (ECU) 8. The ECU 8 includes a microprocessor, memory, (address, control and data) bus lines and other hardware and software to perform tasks of engine control. The idle speed control system 6 also includes an electronic transmission controller (EATX) 10 connected to the ECU 8 and a transmission (not shown) such as an automatic transmission. The idle speed control system 6 further includes a crankshaft sensor 11 for monitoring the speed of the crankshaft in the engine 7, a coolant temperature sensor 12 for monitoring the temperature of the engine coolant, and a battery or environmental ambient air temperature sensor 14 for monitoring the temperature of a battery or environmental ambient air. The idle speed control system 6 further includes a throttle position sensor 16 for monitoring the position of a throttle 17, an air conditioning (A/C) system switch 18 for monitoring the A/C system ON/OFF status, and a battery voltage sensor 20 for monitoring the voltage level of the battery. It should be appreciated that the sensors 11, 12, 14, 16, 18 and 20 are connected to the ECU 8 and the internal combustion engine 7. It should also be appreciated that the idle speed control system 6 may include other hardware (not shown) to perform or carry out the variable target idle speed control methodology to be described.

Figure 2:
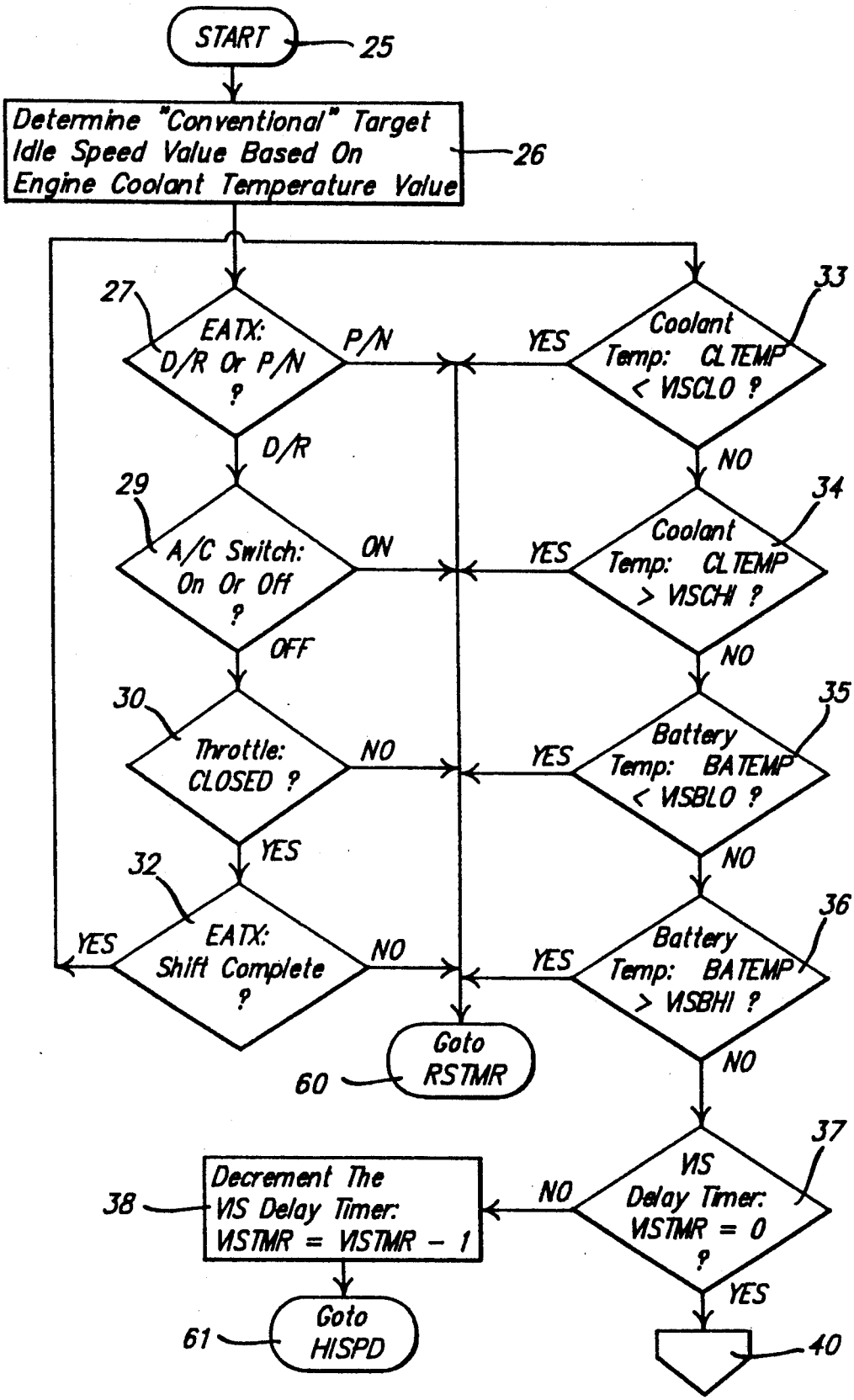
FIGS. 2–4 are flowcharts of the variable target idle speed control methodology according to the present invention.
Figure 3:
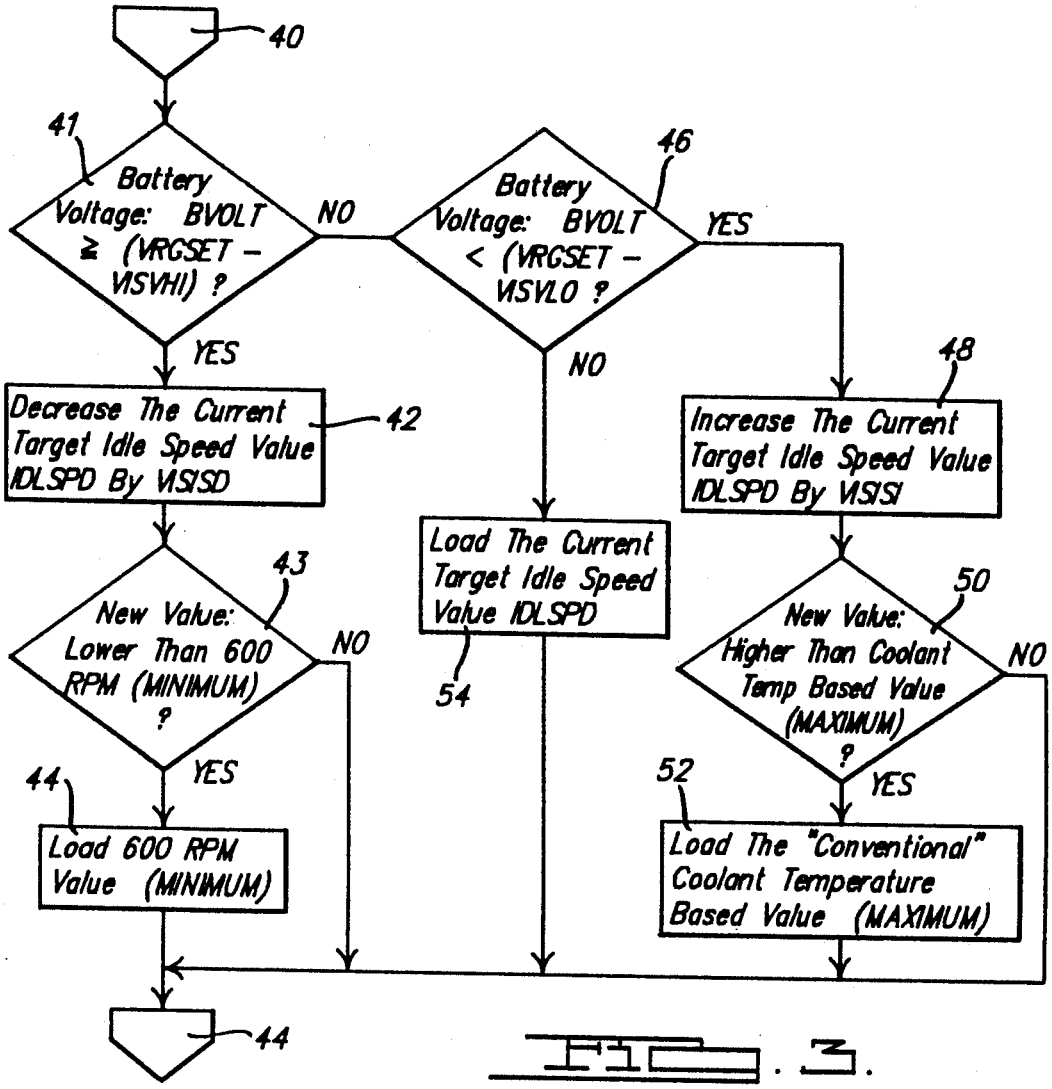
Figure 4:
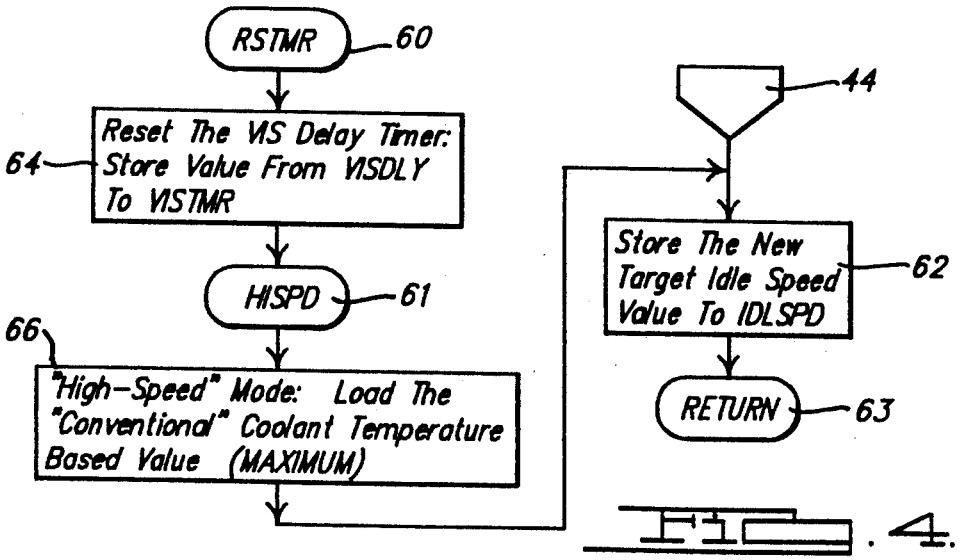

Referring to FIGS. 2-4, a method of variable target idle speed control for the internal combustion engine using the idle speed control system 6 is shown. In FIG. 2, this part of the routine or methodology checks for fulfillment of all enabling conditions and successful completion of a time delay after the enabling conditions have been fulfilled. The methodology is called from a "master" engine control program where it begins or starts in bubble 25 and advances to block 26. In block 26, the methodology determines a "conventional" target or desired idle speed value and temporarily stores this value in the memory of the ECU 8. This "conventional" target idle speed value is based on the temperature of the engine coolant. The coolant temperature sensor 12 senses the temperature of the engine coolant and sends an appropriate signal to the ECU 8 where it is converted to a value that corresponds to the engine coolant temperature and the value is stored in memory (CLTEMP). The "conventional" target idle speed value is calculated from a calibration table that is stored in memory. The calibration table holds target idle speeds as a function of CLTEMP. After the "conventional" coolant temperature based target idle speed value is determined and temporarily stored, the methodology falls through to decision block 27.

In decision block 27, the methodology determines if the transmission is in a "loaded" condition (e.g., in drive or reverse) or an "unloaded" condition (e.g., in park or neutral). The EATX 10 determines what operating condition the transmission is in and the sends this signal to the ECU 8 which will store a value such as one (1) or zero (0) in memory corresponding to whether the transmission is in a "loaded" condition or an "unloaded" condition. If the transmission is in an "unloaded" condition (park or neutral), the methodology advances to bubble 60 in FIG. 4 to be described. If the transmission is in a "loaded" condition (drive or reverse), the methodology advances to decision block 29.

In decision block 29, the methodology determines if the air conditioning system is ON or OFF. The air conditioning system switch 18 sends a signal to the ECU 8 which will store a value such as one (1) or zero (0) in memory corresponding to whether the A/C system is ON or OFF. If the A/C system is ON, the methodology advances to bubble 60 to be described. If the A/C system is OFF, the methodology advances to decision block 30.

In decision block 30, the methodology determines if the throttle is in a "closed" or "not closed" position. The throttle position sensor 16 senses the position of the throttle and sends an appropriate signal to the ECU 8 where it is converted to a value that corresponds to the throttle position and the value is stored in memory (THR). The THR value is compared to a predetermined value to determine if the throttle is "closed" or "not closed." If the THR value is greater than the predetermined value, the throttle is considered to be "not closed" and the methodology advances to bubble 60 to be described. If the THR value is less than or equal to the predetermined value, the throttle is considered to be "closed" and the methodology will pass through to decision block 32.

In decision block 32, the methodology determines from the EATX 10 whether the transmission is in the process of shifting gears or if it has completed a shift and sends an appropriate signal to the ECU 8 which is stored in memory. If the shift is not completed, the methodology advances to bubble 60 to be described. If the shift is completed, the methodology will pass on to decision block 33.

In decision block 33, the methodology determines whether the engine coolant temperature (CLTEMP) is less than a predetermined low temperature value (VISCLO) by comparing them to each other. VISCLO is a minimum predetermined value such as 170.6 degrees fahrenheit stored in memory of the ECU 8. If CLTEMP is less than VISCLO, the methodology advances to bubble 60 to be described. If CLTEMP is not less than VISCLO, the methodology will pass on to decision block 34. In decision block 34, the methodology determines if CLTEMP is greater than a predetermined high temperature value (VISCHI) by comparing them to each other. VISCHI is a predetermined high value such as 215.6 degrees fahrenheit stored in memory of the ECU 8. If CLTEMP is greater than VISCHI, the methodology advances to bubble 60 to be described. If CLTEMP is not greater than VISCHI, the methodology advances to decision block 35. Therefore, if the engine coolant temperature is either too cold or too hot, then the variable target idle speed feature will not be activated or enabled.

In decision block 35, the methodology determines whether the "battery" temperature (BATEMP) is less than a predetermined low temperature value (VISBLO) by comparing them to each other. The battery temperature sensor 14 actually measures the ambient temperature of the ECU 8 and sends an appropriate signal to the ECU 8 where it is converted to a value that corresponds to the actual ECU 8 temperature and the value is stored in memory (BATEMP). This value is used to approximate the environmental ambient air temperature in the absence of a separate ambient air temperature sensor. VISBLO is a predetermined value such as 39.2 degrees fahrenheit stored in memory of the ECU 8. If BATEMP is less than VISBLO, the methodology advances to bubble 60 to be described. If BATEMP is greater than or equal to VISBLO, the methodology will pass through to decision block 36. In decision block 36, the methodology determines whether BATEMP is greater than a predetermined high temperature value (VISBHI) by comparing them to each other. VISBHI is a predetermined value such as 89.6 degrees fahrenheit stored in memory of the ECU 8. If BATEMP is greater than VISBHI, the methodology advances to bubble 60 to be described. If BATEMP is not greater than VISBHI, the methodology advances to decision block 37. Therefore, if the environmental ambient air temperature (approximated by BATEMP) is either too cold or too hot, the variable target idle speed feature will not be activated or enabled.

In decision block 37, the methodology determines if a delay timer (VISTMR) is equal to a predetermined value such as zero (0). The delay timer is found in the ECU 8 and delays the implementation of the variable target idle speed routine or methodology for a predetermined time (VISDLY) after all the previous enabling conditions are met. VISDLY is a predetermined value which is loaded into the VISTMR, every time one of the enabling conditions set out above is violated. VISDLY is a predetermined value such as 2.74 seconds stored in memory of the ECU 8. If VISTMR is not equal to zero, the methodology advances to block 38 and decrements VISTMR by a value of one (1) and stores this new value in VISTMR. The methodology then advances to bubble 61 in FIG. 4 to be described. If VISTMR does equal zero, the delay is complete and the methodology passes through bubble 40 to decision block 41 in FIG. 3.

Now referring to FIG. 3, this part of the routine or methodology actually controls the variable target idle speed of the engine 7 via a battery voltage level feedback. The battery voltage sensor 20 measures the battery voltage and sends an appropriate signal to the ECU 8 where it is converted to a value that corresponds to the actual battery voltage level and the value (BVOLT) is stored in the memory of the ECU 8. The target battery voltage level (VRGSET) such as 14 Volts DC is determined in a separate routine (not described) and stored in the memory of the ECU 8. A separate alternator field control routine (not described) periodically compares BVOLT to VRGSET and regulates the switching of the alternator field to have BVOLT match VRGSET, thus, balancing the engine's varying electrical loads with the alternator output. The battery voltage level feedback is also used to balance electrical loads with the alternator output by varying the idle speed. When all of the enabling conditions have been met and the time delay has been completed (in FIG. 2), the methodology advances to decision block 41.

Figure 5:
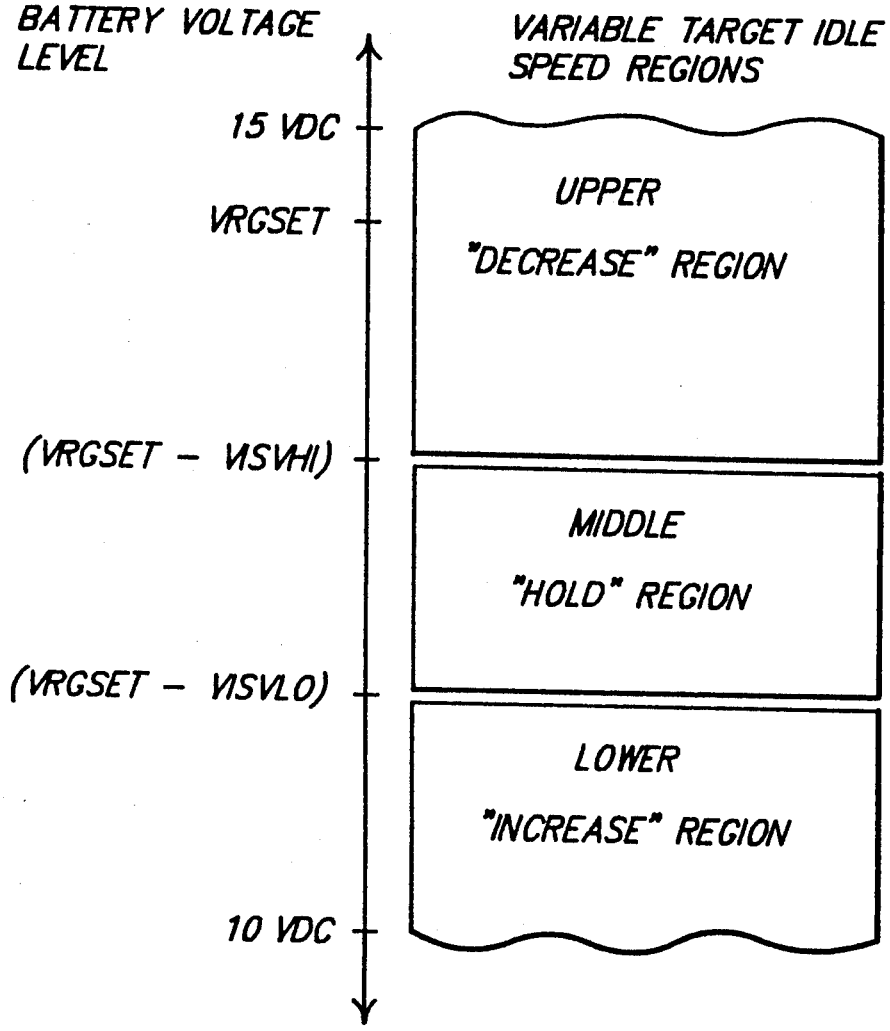
FIG. 5 is a diagram of battery voltage levels and variable target idle speed regions for the variable target idle speed control methodology of FIGS. 2–4.

In decision block 41, the methodology determines whether BVOLT is greater than or equal to a predetermined "high" battery voltage level (VRGSET−VISVHI). The value (VRGSET−VISVHI) defines a boundary between an upper voltage region where the variable target idle speed will be decreased and a middle voltage region where the variable target idle speed will be held at a constant value as illustrated in FIG. 5. To obtain the predetermined "high" battery voltage level, a predetermined "high" voltage offset value (VISVHI) is subtracted from the predetermined desired battery voltage level (VRGSET). VISVHI has a predetermined value such as 0.372 Volts DC and is stored in the memory of the ECU 8. If BVOLT is not greater than or equal to (VRGSET−VISVHI), the methodology advances to decision block 46, to be described. If BVOLT is greater than or equal to (VRGSET−VISVHI), the methodology enters block 42 where a current target idle speed (IDLSPD), determined in a previous execution of the variable target idle speed control routine, will be "ramped down."

In block 42, the methodology decreases IDLSPD by a predetermined idle speed decrease amount or value (VISISD). VISISD has a predetermined value stored in memory of the ECU 8 such as 0.125 RPM per control routine execution. The control routine is executed a predetermined frequency such as 93 Hertz. VISISD will be subtracted from IDLSPD each execution of the routine when all the enabling conditions are met, the time delay has been completed, and BVOLT is greater than or equal to the (VRGSET−VISVHI) value. The magnitude of VISISD and the frequency of the control routine execution determines the rate at which the variable target idle speed decreases. The magnitude is chosen to allow the idle speed to be ramped down slow enough to allow for a "soft landing" in the hold region and avoid engine speed cycling that could occur if the current target idle speed is changed too fast. The target idle speed will be decreased until the BVOLT value falls within the hold region or until the idle speed reaches a predetermined minimum value (FIG. 5).

From block 42, the methodology advances to decision block 43 and determines if the decremented or new idle speed value (IDLSPD−VISISD) is lower than a predetermined minimum value. The predetermined minimum value is a minimum target engine idle speed value such as six hundred (600) RPM stored in memory of the ECU 8. If the (IDLSPD−VISISD) value is lower than the 600 RPM minimum value, the methodology advances to block 44 and loads the 600 RPM minimum value. After block 44 is completed or if the new (IDLSPD−VISISD) value is not lower than the 600 RPM minimum value, the methodology advances through block 44 to block 62 in FIG. 4 to store the appropriate new value of the target idle speed to IDLSPD. The methodology then advances to bubble 63 and returns to the master engine control program.

Referring back to decision block 41 in FIG. 3, if BVOLT is not greater than or equal to the predetermined "high" battery voltage level (VRGSET−VISVHI), the methodology passes through to decision block 46. In decision block 46, the methodology determines whether BVOLT is less than a predetermined "low" battery voltage level (VRGSET−VISVLO). The value (VRGSET−VISVLO) defines a boundary between the middle voltage region where the variable target idle speed will be held at a constant value and the lower voltage region where the variable target idle speed will be increased as illustrated in FIG. 5. To obtain the predetermined "low" battery voltage level, a predetermined "low" voltage offset value (VISVLO) is subtracted from the desired battery voltage level (VRGSET). VISVLO has a predetermined value such as 0.620 Volts DC and is stored in the memory of the ECU 8. If BVOLT is less than (VRGSET−VISVLO), the methodology advances to block 48 where the current target idle speed (IDLSPD), determined in a previous execution of the variable target idle speed control routine, will be "ramped up."

In block 48, the methodology increases IDLSPD by a predetermined idle speed increase amount or value (VISISI). VISISI has a predetermined value stored in the memory of the ECU 8 such as 0.500 RPM per control loop execution. This VISISI value will be added to IDLSPD each execution of the routine or methodology when all the enabling conditions are met, the time delay has been completed, and BVOLT is less than the (VRGSET−VISVLO) value. VISISI is greater than VISISD which causes the target idle speed to "ramp up" at a faster rate than it "ramps down," resulting in quicker recoveries back to the hold region if BVOLT is too low. The target idle speed will be increased until BVOLT falls within the "hold" region or until the target idle speed value reaches the "conventional" coolant temperature based maximum value previously determined in block 26.

From block 48, the methodology advances to decision block 50 and determines if the incremented or new idle speed value (IDLSPD+VISISI) is greater than the predetermined "conventional" coolant temperature based maximum value such as seven hundred (700) RPM previously determined in block 26 and temporarily stored in memory of the ECU 8. If the (IDLSPD+VISISI) value is greater than the "conventional" coolant based maximum value, the methodology enters block 52 and loads the "conventional" coolant based maximum value. After block 52 is completed or the new (IDLSPD+VISISI) value is not greater than the "conventional" coolant based maximum value, the methodology advances to block 62 in FIG. 4 to store the appropriate new value of the target idle speed to IDLSPD.

The methodology then advances to bubble 63 and returns.

Referring back to decision block 46 in FIG. 3, if BVOLT is not less than the predetermined "low" battery voltage level (VRGSET−VISVLO), the methodology advances to block 54. At this point, BVOLT is in the middle voltage region because it is less than the "high" battery voltage level (VRGSET−VISVHI) and greater than or equal to "low" battery voltage level (VRGSET−VISVLO). When BVOLT falls into this region, the variable target idle speed will be held at a constant value because the engine's varying electrical loads are being balanced by the alternator output. Therefore, in block 54, the methodology loads the current target idle speed value (IDLSPD) determined in the previous execution of the variable target idle speed control routine and advances to block 62 to store the value of the target idle speed to IDLSPD. The methodology then continues to bubble 63 and returns.

Referring to FIG. 4, the methodology will branch to bubble 60 if any one of the enabling conditions described in FIG. 2 are not met. From bubble 60 the methodology advances to block 64. In block 64, the methodology resets the delay timer. The delay timer is reset by storing the value of the variable target idle speed delay (VISDLY) to the variable target idle speed delay timer (VISTMR) as previously described. After leaving block 64, the methodology enters the high speed mode routine (HISPD) in bubble 61 and advances to block 66. In block 66, the methodology loads the "conventional" coolant temperature based target idle speed value previously determined in block 26. The methodology then advances to block 62 to store the value of the target idle speed to IDLSPD. This will in effect keep the engine idling at the same maximum target idle speed whenever one of the enabling conditions are not met or the delay timer has not gone through its complete cycle. The methodology then continues to bubble 63 and returns.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of controlling the idle speed of an internal combustion engine having sensors for monitoring predetermined conditions such as engine coolant temperature, engine RPM, and battery voltage, said method comprising the steps of:

sensing predetermined conditions of an internal combustion engine by a plurality of sensors;

determining if the predetermined conditions have been met by signals from the sensors;

disabling control of variable target idle speed if the predetermined conditions have not been met;

enabling control of variable target idle speed if the predetermined conditions have been met;

varying the target idle speed between predetermined minimum and maximum values; and controlling an idle speed air bypass valve based on the target idle speed to control the idle speed of the internal combustion engine.

2. A method of controlling an idle speed of an internal combustion engine having sensors for monitoring predetermined conditions such as engine coolant temperature, engine rotational speed, battery voltage, battery temperature, throttle position, ambient air temperature, and transmission status, said method comprising the steps of:

sensing the predetermined conditions of the internal combustion engine by a plurality of sensors;

determining if predetermined conditions have been met by evaluating signals from the sensors;

sensing if a shift of the transmission has been completed;

comparing the engine coolant temperature with a predetermined value;

comparing the battery and/or environmental ambient air temperature with a predetermined value;

implementing a delay timer for the variable target idle speed controller;

determining if the battery voltage is within one of a plurality of different ranges;

increasing or decreasing the target idle speed between a maximum and minimum value by a predetermined amount based on the range of the battery voltage; and controlling an idle speed air bypass valve based on the target idle speed to control the idle speed of the internal combustion engine.

3. A method as set forth in claim 2 including the steps of:

storing the "conventional" coolant temperature based target idle speed;

determining if the engine transmission is in a "loaded" condition (in drive or reverse) or an "unloaded" condition (in park or neutral);

determining if the air conditioner switch is in the on or off position; and determining if the engine throttle is in the closed or not closed position.

4. A method as set forth in claim 2 including the steps of:

determining if the said engine coolant temperature is less than a predetermined value or if said engine coolant temperature is greater than another predetermined value; and determining if the said battery temperature and/or environmental ambient air temperature is less than a predetermined value or if the said battery temperature and/or environmental ambient air temperature is greater than another predetermined value.

5. A method as set forth in claim 2 including the steps of:

decrementing the said variable target idle speed delay timer by a predetermined value;

determining if the said variable target idle speed delay timer equals a predetermined value; and activating the said variable target idle speed controller.

6. A method as set forth in claim 2 including the steps of:

determining if the said battery voltage is greater than or equal to the difference of two predetermined values;

decreasing the current target idle speed value by a predetermined value;

determining if the new target idle speed value is less than a predetermined value; and loading the predetermined minimum value for the said target idle speed.

7. A method as set forth in claim 2 including the steps of:

determining if the said battery voltage is not less than the difference of two predetermined values; and loading the current said target idle speed value into the engine controller.

8. A method as set forth in claim 2 including the steps of:

determining if the said battery voltage is less than the difference of two predetermined values;

increasing the said current target idle speed value by a predetermined value;

determining if the new target idle speed value is greater than said "conventional" coolant temperature based maximum value; and loading the said "conventional" coolant temperature based maximum value into the engine controller.

9. A method as set forth in claim 2 including the step of resetting the delay timer with a predetermined value when said preconditions are not met.

10. A method as set forth in claim 2 including the step of loading the said "conventional" coolant temperature based maximum target idle speed value when said preconditions are not met.

11. A method of controlling an idle speed of an internal combustion engine by a control system having an electronic control unit and sensors for monitoring engine coolant temperature, engine RPM, and battery voltage for the engine, said method comprising the steps of:

sensing engine coolant temperature by a sensor;

determining a target idle speed based on the sensed engine coolant temperature;

sensing predetermined conditions of the engine by a plurality of sensors;

determining if the predetermined conditions have been met;

sensing battery voltage;

determining if the battery voltage is within one of a plurality of different ranges;

increasing or decreasing the target idle speed between a maximum and minimum value by a predetermined amount based on the range of the battery voltage; and controlling an idle speed air bypass valve based on the target idle speed to control the idle speed of the internal combustion engine.

12. A method as set forth in claim 11 wherein said step of sensing predetermined conditions comprises sensing a transmission operating mode, air conditioning operating mode, and throttle operating mode.

13. A method as set forth in claim 12 including the step of determining if the transmission operating mode, air conditioning operating mode, and throttle operating mode are at predetermined parameters.

14. A method as set forth in claim 13 including the step of comparing the sensed engine coolant temperature with a predetermined minimum and maximum value.

15. A method as set forth in claim 14 including the step of comparing the sensed battery voltage with a predetermined minimum and maximum value.

16. A method as set forth in claim 15 including the step of performing a delay sequence by decrementing a variable idle speed delay timer.

17. A method as set forth in claim 16 wherein said step of determining the battery voltage includes the step of comparing the sensed battery voltage with a predetermined maximum and minimum value.

18. A method as set forth in claim 17 including the step of loading a new value for the target idle speed based on the increased or decreased target idle speed.

19. A method as set forth in claim 11 including the step of resetting a variable idle speed delay timer if the predetermined conditions have not been met.

20. A method as set forth in claim 19 including the step of implementing a high speed mode for variable idle speed control after said step of resetting.

* * * * *